United States Patent [19]

Kneipkamp

[11] 4,308,219

[45] Dec. 29, 1981

[54] TAMPER RESISTANT CHOKE COVER

[75] Inventor: Lawrence E. Kneipkamp, Collinsville, Ill.

[73] Assignee: ACF Industries, Inc., New York, N.Y.

[21] Appl. No.: 216,325

[22] Filed: Dec. 15, 1980

[51] Int. Cl.[3] ..... F02M 1/10

[52] U.S. Cl. ..... 261/39 B; 137/382; 261/DIG. 84

[58] Field of Search ..... 261/39 B, DIG. 84; 137/382

[56] References Cited

U.S. PATENT DOCUMENTS

| | | | |
|---|---|---|---|
| 2,029,955 | 2/1936 | Taylor | 137/382 |
| 2,140,529 | 12/1938 | Kemp | 137/382 |
| 2,969,964 | 1/1961 | Highley | 261/39 |
| 2,988,344 | 6/1961 | Smitley | 261/39 |
| 3,227,428 | 1/1966 | Charron | 261/39 |
| 3,392,748 | 7/1968 | Geyer | 137/382 |
| 4,120,918 | 10/1978 | Codling | 261/41 D |
| 4,152,377 | 5/1979 | Takata | 261/39 B |
| 4,193,946 | 3/1980 | Dye | 261/39 B |
| 4,269,792 | 5/1981 | Winkley | 261/39 B |

FOREIGN PATENT DOCUMENTS

| | | | |
|---|---|---|---|
| 54-117832 | 12/1979 | Japan | 261/DIG. 38 |

*Primary Examiner*—Tim R. Miles

*Attorney, Agent, or Firm*—J. Joseph Muller

[57] ABSTRACT

A carburetor improvement for inhibiting tampering with a thermostatic choke coil after carburetor manufacture. A cover (3) fits over a choke coil housing (H) to enclose a choke lever, the thermostatic coil being mounted inside the cover. The cover has a circumferential flange (5) which abuts the outer surface of the housing, the flange having a notch (9) formed therein and the cover being rotatable about the outer surface of the housing to position one end of the coil relative to the choke lever. A retainer (7) locks the cover in a fixed position once the one end of the coil is located with respect to the choke lever. The retainer has a tab (11) insertable in the notch to prevent further rotation of the cover. A screw (15) having a detachable head (17) unremovably secures the retainer to the carburetor whereby once the retainer is secured, further movement of the cover is prevented.

6 Claims, 6 Drawing Figures

TAMPER RESISTANT CHOKE COVER

BACKGROUND OF THE INVENTION

This invention relates to carburetors and, more particularly, to a carburetor improvement for making a carburetor choke setting tamper resistant.

As a step toward reducing engine emissions, various tamperproofing requirements for automobile carburetors have been promulgated. The purpose of these regulations is to have various carburetor components made tamper resistant so a vehicle owner or mechanic cannot change factory settings after the vehicle is in private hands. One particular area of concern is choke operation. United States patent application Ser. No. 90,733, filed Nov. 2, 1979, discloses a tamper resistant choke pull-off mechanism which inhibits someone from tampering with the linkage between the choke and a remotely located vacuum pull-off unit. Not all carburetors, however, have such units. Further, there is the problem of someone wanting to change the factory adjustment between the bimetal choke coil and choke lever, which adjustment controls choke valve opening during engine warm-up. One approach to resolving this latter problem is disclosed in United States patent application Ser. No. 120,973, filed Feb. 13, 1980, now U.S. Pat. No. 4,269,792. This application describes an adjustable lever for use with the bimetal coil. While this arrangement does provide for proper adjustment, the tamper resistant arrangement described may not be used on all carburetors, so a tamper resistant means is still necessary for carburetors having the traditional coil-choke lever design.

SUMMARY OF THE INVENTION

Among the several objects of the present invention may be noted the provision of a retainer for a carburetor choke coil cover; the provision of such a retainer which locks the cover in place during carburetor manufacture after the position of the coil is adjusted relative to a choke lever in a housing over which the cover fits; and the provision of a retainer which cannot be readily removed after carburetor assembly so the adjustment cannot be tampered with after the carburetor is in private hands.

Briefly, the improvement of the present invention comprises means for inhibiting tampering with a bimetallic choke coil after carburetor manufacture thereby to change its setting relative to a choke lever and modify the air-fuel ratio of mixture produced by the carburetor during engine warmup. The inhibiting means includes a cover fitting over a housing to enclose the choke lever, the coil being mounted inside the cover. The cover has a circumferential flange which abuts the outer surface of the housing. The flange has a notch formed therein and the cover is rotatable about the outer surface of the housing to position one end of the coil relative to the choke lever. A retainer locks the cover in a fixed position once the one end of the coil is located with respect to the choke lever. The retainer has a tab insertable in the notch to prevent further rotation of the cover. Means are provided for unremovably securing the retainer to the carburetor whereby once the retainer is secured, further movement of the cover is prevented. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
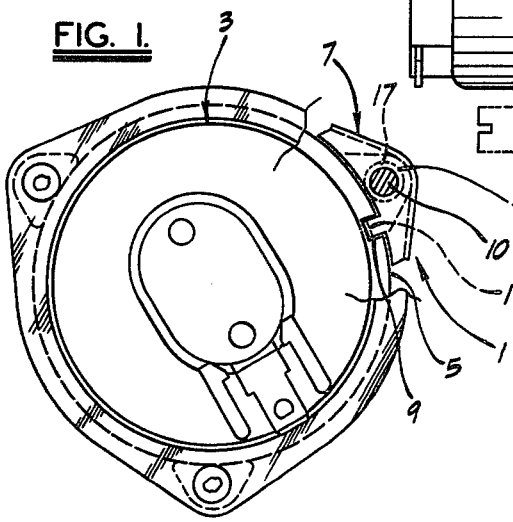
FIG. 1 is a front elevation of a carburetor choke housing cover illustrating the improvement of the present invention.

Referring to the drawings, a carburetor C for an internal combustion engine (not shown) has an air passage AP. A choke valve CV includes a disk D mounted on a rotatable choke shaft CS. One end of the choke shaft extends into a choke coil housing H. As is well known in the art, a thermostatic or bimetallic coil (not shown) acts on a choke lever (also not shown) positioned within the housing to exert a closing force on choke valve CV, this force decreasing as engine temperature increases. Proper control of choke valve opening is important to help reduce engine emissions and for this purpose the end of the bimetallic coil acting on the choke lever is adjusted relative to the choke lever during carburetor manufacture.

The improvement of the present invention comprises means generally indicated 1 for inhibiting tampering with the bimetallic coil adjustment after carburetor manufacture. This is important to prevent someone from changing the coil setting and thereby modifying the air-fuel ratio of the mixture produced by the carburetor during engine warmup. In turn, this adversely effects both engine exhaust emissions and fuel economy.

Means 1 includes a cover 3 fitting over housing H. Cover 3 is cup shaped with the bimetallic coil being mounted inside the cover. One end of the coil is attached to the inner face of cover 3 with the other end of the coil being free. This free end of the coil is so shaped as to contact the choke lever and exert the choke valve closing force on it as previously discussed. Cover 3 has a circumferential flange 5 which abuts the outer surface of housing H when the cover is placed over the housing. The cover is rotatable about the outer surface of the housing to properly position the free end of the coil with respect to the choke lever.

Means 1 further includes a retainer 7 for locking cover 3 in place after the bimetallic coil has been indexed. As shown, flange 5 has a notch 9 formed therein and retainer 7, which has a segmental arc shape, has a tab 11 depending from its inner edge. The tab is sized to fit into notch 9 and when so inserted prevents further rotation of cover 3. A threaded bore 10 is formed in the carburetor body adjacent the outer surface of housing H and to the outside of the housing. Retainer 7 is positioned over bore 10 and has an opening 13 therethrough of the same diameter as that of the bore. A screw 15 has a detachable or breakaway head 17. The screw is threaded into bore 10 through the opening in retainer 7 and is tightened until the head snaps off. Screw 15 is now unremovable and retainer 7 is secured to the carburetor. Further, tab 11 locks cover 3 in place so further movement of the cover is prevented.

Figure 2:
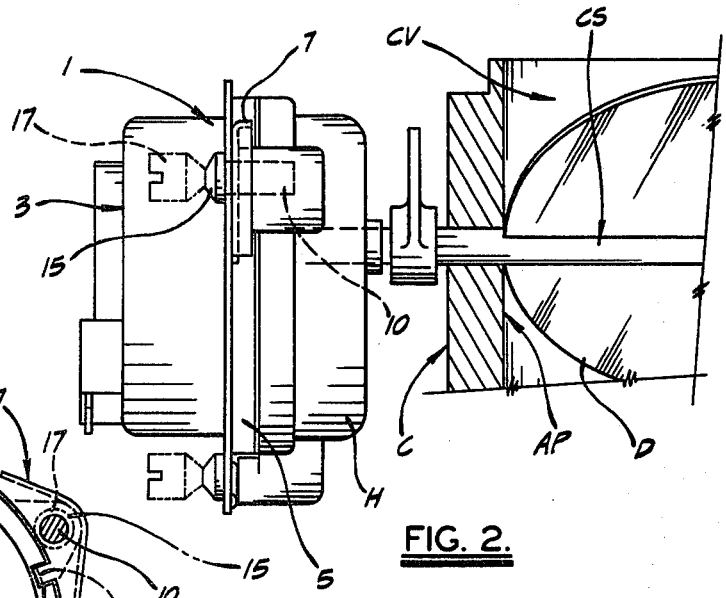
FIG. 2 is a side elevation of the choke housing cover of FIG. 1.
Figure 3:
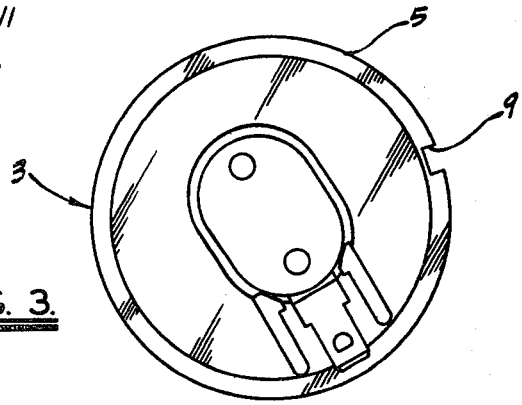
FIG. 3 is a top plan view of a choke housing cover used with the improvement of the present invention.
Figure 4:
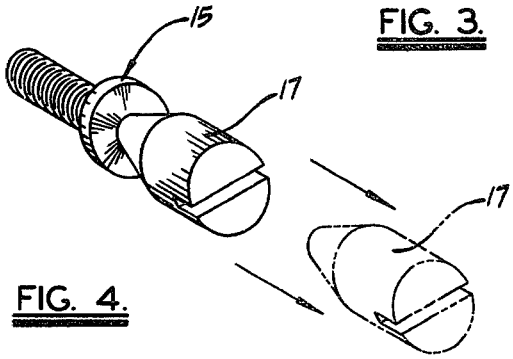
FIG. 4 is a perspective view of an attachment screw used with the improvement of the present invention, the screw having a breakaway head.
Figure 5:
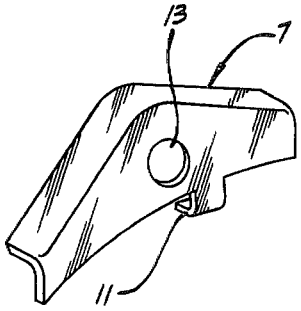
FIG. 5 is a perspective view of a retainer used to hold the choke housing cover in place.
Figure 6:
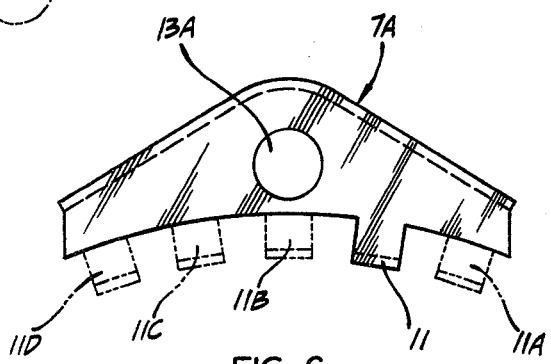
FIG. 6 is a perspective view of a second embodiment of the retainer.

Because the bimetallic coil may be indexed to more than one position, the position to which cover 3 is ultimately rotated may be other than that shown in FIGS. 1 and 2. In actuality, the bimetallic coil is rotated to one of five positions, each position being approximately five (5) degrees from the next. Since the position of notch 9 depends upon the position to which the coil is adjusted, the notch may also be at one of five positions. To lock cover 3 in place regardless of the ultimate position of the notch, a series of retainers are provided. As shown in FIG. 6, retainer 7A is the same as that described above and shown in FIG. 5. As indicated, however, the tab on the retainer is at one of five positions designated 11, 11A, 11B, 11C, and 11D. Tab 11A of retainer 7A is five (5) degrees to the right of tab 11, while tab 11B is five (5) degrees to the left of tab 11. Tab 11C is five (5) degrees to the left of tab 11B and tab 11D is five (5) degrees to the left of tab 11C.

Another way of achieving the same result as shown in FIG. 6, is for flange 5 to have five notches formed therein, each notch being five degrees apart from the next. In this embodiment, only one retainer 7 is required to lock cover 3 in any one of its five positions.

Lastly, the retainer may be such as the retainer 7A shown in FIG. 6. The retainer would have five detachable tabs, each five degrees apart from the next in the same way tabs 11, 11A, 11B, 11C and 11D are five degrees apart. In use, cover 3 is first properly positioned. Then, it is determined which tab will lock the cover in place. The other four tabs are then detached using a suitable tool and the retainer installed in the manner previously described.

Regardless of the particular embodiment employed, the retainer locks the cover in place and since the breakaway screw cannot be removed, later adjustment of the coil is prevented.

In view of the above, it will be seen that the several objects of the invention are achieved and other advantageous results obtained.

As various changes could be made in the above constructions without departing from the scope of the invention, it is intended that all matter contained in the above description and shown in the accompanying drawing shall be interpreted as illustrative and not in a limiting sense.

What is claimed is:

1. In a carburetor for an internal combustion engine, the carburetor having an air induction passage, a choke valve mounted in the passage and including a disk mounted on a rotatable choke shaft, a choke lever attached to one end of the choke shaft and located in a housing formed in the body of the carburetor and a bimetallic coil acting on the choke lever to exert a choke valve closing force on the choke shaft which decreases as engine temperature increases, the force exerted by the coil on the choke lever being preset during manufacture of the carburetor to control the air-fuel ratio of the mixture produced by the carburetor and supplied to the engine during warmup, the improvement comprising means for inhibiting tampering with the bimetallic coil setting after manufacture thereby to change the setting and modify the air-fuel ratio of mixture produced during engine warmup, the inhibiting means including a cover fitting over the housing to enclose the choke lever, the bimetallic coil being mounted inside the cover; the cover having a circumferential flange which abuts the outer surface of the housing, the flange having a notch formed therein and the cover being rotatable about the outer surface of the cavity to position one end of the coil relative to the choke lever; a retainer for locking the cover in a fixed position once the one end of the coil is located with respect to the choke lever, the retainer having a tab insertable in the notch to prevent further rotation of the cover, and means for unremovably securing the retainer to the carburetor whereby once the retainer is secured further movement of the cover is prevented.

2. The improvement as set forth in claim 1 wherein the inhibiting means includes a series of retainers, each having a tab located at a different position relative to the location of the tabs on the other retainer in the series, the retainer selected for use with the cover depending upon the positioning of the cover over the housing.

3. The improvement as set forth in claim 2 wherein the retainer has a segmental arc shape with the tab depending from the inner edge of the retainer.

4. The improvement as set forth in claim 1 wherein the retainer has a plurality of spaced apart detachable tabs, all but one of which are broken off prior to installation of the retainer, the tab remaining being determined by the position of the cover over the housing.

5. The improvement as set forth in claim 1 wherein the cover flange has a series of notches therein, the tab fitting in one of the notches, the particular notch being determined by the positioning of the cover over the housing.

6. The improvement as set forth in claim 2 wherein the retainer securing means comprises a threaded screw threadable into a threaded hole in the housing through an opening in the retainer, the screw having a breakaway head which is broken off after the screw is threaded into the hole.

* * * * *